US008746444B2

(12) United States Patent
Dehlin

(10) Patent No.: US 8,746,444 B2
(45) Date of Patent: Jun. 10, 2014

(54) PACKAGE AND INSERT ADAPTED TO FORM PART OF A PACKAGE

(75) Inventor: Marcus Dehlin, Hammaro (SE)

(73) Assignee: Stora Enso AB, Falun (SE)

( * ) Notice: Subject to any disclaimer, the term of this patent is extended or adjusted under 35 U.S.C. 154(b) by 160 days.

(21) Appl. No.: 12/599,488

(22) PCT Filed: Jan. 25, 2008

(86) PCT No.: PCT/SE2008/000070

§ 371 (c)(1),
(2), (4) Date: Nov. 9, 2009

(87) PCT Pub. No.: WO2008/140370

PCT Pub. Date: Nov. 20, 2008

(65) Prior Publication Data

US 2010/0236957 A1 Sep. 23, 2010

(30) Foreign Application Priority Data

May 10, 2007 (SE) ..... 0701123

(51) Int. Cl.
*B65D 83/04* (2006.01)

(52) U.S. Cl.
USPC ..... 206/1.5; 229/125.125; 229/913; 220/345.4

(58) Field of Classification Search
CPC ..... B65D 21/086; B65D 5/38; B65D 83/04; A61B 19/02
USPC ..... 206/1.5, 528–540, 534.1, 534.2, 524.2, 206/387.12; 229/125.125, 220, 913, 229/125.12, 5.84, 210; 488/1.5; 220/345.2, 220/345.4
See application file for complete search history.

(56) References Cited

U.S. PATENT DOCUMENTS

| | | | | | |
|---|---|---|---|---|---|
| 1,928,889 | A | * | 10/1933 | Guyer | 229/125.125 |
| 2,790,587 | A | * | 4/1957 | Contant | 206/532 |
| 3,074,611 | A | * | 1/1963 | Tolaas | 229/125.125 |
| 3,648,918 | A | * | 3/1972 | Van Inwagen | 229/125.125 |
| 3,828,923 | A | * | 8/1974 | Phillips, Jr. | 229/125.125 |
| 5,511,665 | A | | 4/1996 | Dressel et al. | |
| 6,491,211 | B1 | | 12/2002 | Evans et al. | |
| 6,676,013 | B2 | * | 1/2004 | Auclair | 229/125.125 |

(Continued)

FOREIGN PATENT DOCUMENTS

| | | |
|---|---|---|
| EP | 1002744 | 5/2000 |
| EP | 1447109 | 8/2004 |

(Continued)

OTHER PUBLICATIONS

Written Opinion of the International Searching Authority, mailed Aug. 6, 2008.

*Primary Examiner* — Andrew Perreault
(74) *Attorney, Agent, or Firm* — Greer, Burns & Crain, Ltd.

(57) ABSTRACT

The disclosure relates to a package comprising a sleeve and an insert, the insert being adapted to be movably received in the sleeve, the insert is adapted to carry and receive a product, the insert is adapted to be reinserted into the sleeve after receipt of said product, the sleeve is adapted to enclose the reinserted insert such that access to said product is limited or denied and reextraction of the insert is limited or denied once the insert has been reinserted into the sleeve. The disclosure further relates to an insert adapted to form a part of a package of the above kind.

7 Claims, 6 Drawing Sheets

(56) References Cited

U.S. PATENT DOCUMENTS

| | | | | |
|---|---|---|---|---|
| 7,299,968 | B2 * | 11/2007 | Mittmann et al. | 229/125.125 |
| 7,377,385 | B2 * | 5/2008 | Giannini et al. | 229/125.125 |
| 2006/0054673 | A1 * | 3/2006 | Mittmann et al. | 229/122.21 |
| 2006/0131205 | A1 | 6/2006 | Sandberg et al. | |
| 2007/0045149 | A1 | 3/2007 | Hession | |
| 2007/0251983 | A1 * | 11/2007 | Freeze | 229/125.125 |

FOREIGN PATENT DOCUMENTS

| | | |
|---|---|---|
| GB | 19123176 | 11/1912 |
| GB | 292686 | 6/1928 |
| GB | 1276702 | 6/1972 |
| JP | 2002225844 | 8/2002 |
| WO | 2005049438 | 6/2005 |
| WO | 2006068602 | 6/2006 |

* cited by examiner

PACKAGE AND INSERT ADAPTED TO FORM PART OF A PACKAGE

This application is a U.S. National Stage under 35 U.S.C. §371 of International Application No. PCT/SE2008/000070, filed Jan. 25, 2008, which claims priority from Swedish Patent Application No. 0701123-2, filed May 10, 2007.

FIELD OF INVENTION

The invention relates to a package comprising a sleeve and an insert, the insert being adapted to be movably, and at least partly extractably, received in the sleeve, the insert is adapted to receive a product, wherein the insert is adapted to be reinserted into the sleeve after receipt of the product.

The present invention also relates to an insert adapted to be movably, and at least partly extractably, received in a sleeve, the insert is adapted to receive a product, wherein the insert is adapted to be reinserted into the sleeve after receipt of the product.

The present invention is especially suitable for, but not limited to, safe storage of hazardous disposable products after usage.

TECHNICAL BACKGROUND

When packaging hazardous products, such as medicaments, syringes, needles, scalpels and razor blades it is of importance to keep the product, both before and after usage, safely stored.

There are today many child resistant packages, especially child resistant pharmaceutical packages, which prevent a child from easy accessing a product. WO2006/068602 A1 and U.S. Pat. No. 5,511,665 discloses two different kind of child resistant pharmaceutical packages. The design of these packages makes it very difficult for children to open it and makes it possible to safely store the product before usage.

However, it is also important to safely store any remains of a used product or products no longer suitable for use, for example used needles or expired medicaments. There are today several packages or containers for safe storage of used needles, one example is disclosed in EP 1447109.

EP 1447109 discloses a medical waste disposal container comprising a hollow container portion and a top cover that is securable to an upper region of said container portion by a snap-fitting arrangement. The upper region of the hollow container is provided with an opening through which waste is received and the top cover includes an inlet through which waste can be inserted for passage to the opening.

The container described in EP 1447109 is adapted for storage of quite a large quantity of needles. These kinds of containers are often placed in hospitals or medical centers for safe storage of used needles.

However, many patients self inject their medicament at home, for example diabetic or cancer patients. For these patients, the present available large containers for storage are impractical. Also, when the patient is traveling or at work it is not a practical solution. It would also be good if the disposable product could be sent by mail to a destination for final disposal, for example to a pharmacy. This is especially suitably for medicaments that have expired, i.e. their best-before date has passed. Instead of leaving the medicaments to a pharmacy, a user can put them in a package for safe storage and mail it to, for example a pharmacy, or other destination for final disposal.

There is thus a need for a small and safe package for storage of hazardous disposable products, such as needles and medicaments, which package is suitable for domestic use.

SUMMARY OF INVENTION

It is an object of the invention to provide a package for safe storage of a hazardous disposable product after usage.

It is also an object of the invention to provide a package for safe storage of a hazardous disposable product before usage. The above objects, as well as other advantages, have been achieved with a package comprising a sleeve and an insert, the insert is adapted to be movably, and at least partly extractably, received in the sleeve, wherein the insert is adapted to receive and carry at least one product, the insert is adapted to be reinserted into the sleeve after receipt of said product, the sleeve is adapted to enclose the reinserted insert such that access to said product is limited or denied, and the insert is adapted to be modified in such a manner that reextraction of the insert is limited or denied once the insert has been reinserted into the sleeve.

The invention makes it possible to store a disposable product, preferably after usage, in a safe and small sized package.

The package may be used as final disposal of expired products, such as medicaments. Thus, it is not necessary to store a product before usage in the package, the product may only be introduced once it is ready for disposal. The package containing the disposable product may be mailed to a destination for final disposal without any risk for the persons handling the mail. It also makes it more convenient to the user since there is no need to deliver the disposable product directly to, for example, a pharmacy.

Preferred embodiments of the invention are apparent from the dependent claims.

The insert of the package may be modified by folding or separating one part of the insert before receipt of the product. Preferably, the insert is modified by the user immediately prior to the receipt of the product. The modified part of the insert is preferably adapted to be separated from the insert by tearing along one or more perforation lines. In this way, the form and/or function of the insert is changed so that, once the product has been received, the insert is prevented from being reextracted from the sleeve.

The insert of the package may also be provided with a grip portion being accessible to a user when the insert is received in the sleeve, wherein the insert is adapted to be modified in such a manner that the grip portion need to be separated from the insert or made inoperable before the insert may receive the product. In this way access to the insert, and thus also to the product, is limited or even denied since there is no grip portion for reextracting the insert from the sleeve.

The package may also comprise at least one locking mechanism that prevents the insert from being extracted or reextracted from the sleeve. The locking mechanism may be a releasable locking mechanism adapted to control movement of the insert in relation to the sleeve. The locking mechanism may be released by a releasing mechanism. In this way access to the product is denied unless the release mechanism is activated. It is thus possible to also limit access to the insert before the insert is modified. This releasable locking mechanism can be, but is not limited to, the same locking mechanisms as described in prior art child resistant pharmaceutical packages.

The locking mechanism of the package may also be activated and adapted to be unreleasable once the insert has been modified and the insert has been reinserted into the sleeve. In this way a more safely storage of the product is achieved, i.e.

it is made very difficult to reextract the insert from the sleeve and access to insert and to the received product is limited or denied.

The package may also comprise a second locking mechanism adapted to be unreleasable once the insert has been modified and the insert has been reinserted into the sleeve. Preferably, the package only comprises a second locking when the first locking mechanism is adapted to be releasable. Once the second locking mechanism is activated, i.e. once the insert has been modified and the insert has been reinserted into the sleeve, access to the insert will be limited or denied. Thus, the releasing of the first locking mechanism does not release the second locking mechanism once it is activated.

The locking mechanism may prevent the insert from being reextracted by a first locking member adapted to be in connection with a second locking member. The releasing mechanism may release the connection between the first and second locking members.

The unreleaseable locking mechanism may prevent the insert from being reextracted by a first locking member adapted to be in connection with a second locking member, which second locking member is revealed or formed after the insert has been modified.

The first locking member is preferably located in the sleeve and the second locking member is preferably located in the insert. In this way, the connection of said first and second locking member will prevent the insert from being reextracted from the sleeve. For example, the insert can be modified by separating one part of the insert in such a manner that a locking member of the insert is revealed. The insert may also be modified by folding one part of the insert in such a manner that a locking member is formed, for example by refold one part of the insert so that a tounge or locking flap is formed on the insert. The revealed or formed locking member may be adapted to connect with a locking member of the sleeve, preferably a locking flap, locking arc or a cut-out, thus preventing the modified insert from being reextracted from the sleeve.

The insert of the package may also be adapted so that reextraction of the insert from the sleeve only is limited or denied in case the insert has received the product before being reinserted into the sleeve. In this way it is assured that the insert has received the product before access to the insert, and thus also to the product, is limited or denied. This may be achieved by adapting the insert in such manner that receipt of the product only is possible once the insert has been modified so that a locking member is revealed or formed. Also, the received product may form or reveal a locking member. The revealed or formed locking member may connect with a locking member located in the sleeve once the insert is reinserted into the sleeve and reextraction of the insert is thus limited or denied.

In this context it may be noted that the insert may be sold as a separate unit adapted to be put into a sleeve thereby forming a package of the kind disclosed above.

An insert may be adapted to be used in a package as described above, wherein the insert is adapted to be movably, and at least partly extractably, received in a sleeve, wherein the insert is adapted to receive and carry at least one product, the insert is adapted to be reinserted into the sleeve after receipt of said product, the sleeve is adapted to enclose the reinserted insert such that access to said product is limited or denied, and the insert is adapted to be modified in such a manner that reextraction of the insert is limited or denied once the insert has been reinserted into the sleeve.

Advantages with the insert are discussed in relation to the corresponding features of the package.

The above objects of the invention has also been achieved with a package comprising a sleeve and an insert, the insert is adapted to be movably, and at least partly extractably, received in the sleeve, the insert is adapted to carry a product of which product at least one part remains after usage, wherein the product is accessible only after the insert is at least partly extracted from the sleeve, the insert is adapted to receive and carry said part of the product after usage of the product, the insert is adapted to be reinserted into the sleeve after receipt of said part of the product, the sleeve is adapted to enclose the reinserted insert such that access to said part of the product is limited or denied, and reextraction of the insert is limited or denied once the insert has been reinserted into the sleeve.

The invention thus makes it possible to store a disposable product, both before and after usage, in a safe and small sized package.

When the product has been used, one part of the product will remain and the remaining part can be reintroduced into the package and stored in a safe way, i.e. access to the remaining part of the product is limited or even denied. This package is especially appropriate for disposable products, which is hazardous before and/or after usage. Especially suitable products are for example syringes, needles, medicaments and sterile products, such as scalpels or razor blades.

It is also possible to mail this package for the same reasons as discussed above.

Preferred embodiments of the invention are apparent from the dependent claims.

The product may be accessible only after the insert has been modified. The insert is preferably modified by folding or separating at least one part of the insert. The part of the insert may be separated from the insert by tearing along one or more perforation lines. Also, the insert is modified, i.e. the form and/or function of the insert is changed, in a manner so that reextraction of the insert is limited or denied once the insert has been reinserted into the sleeve. In this way, by removing the product, the insert will at the same time be modified in such a manner that reextraction of the insert from the sleeve is limited or denied once the insert has been reinserted.

The insert of the package may also be provided with a grip portion being accessible to a user when the insert is received in the sleeve, wherein the insert is adapted to carry the product in such a manner that the grip portion needs to be separated from the insert or made inoperable before the product may be removed from the insert. In this way access to the insert, and thus also to the remaining part of the product is limited or even denied since there is no grip portion for reextracting the insert from the sleeve.

The package may also comprise at least one locking mechanism that prevents the insert from being extracted or reextracted from the sleeve. The locking mechanism may be a releasable locking mechanism adapted to control movement of the insert in relation to the sleeve. The locking mechanism may also be activated and adapted to be unreleasable once the insert has been modified and the insert has been reinserted into the sleeve. The package may also comprise a second locking mechanism adapted to be unreleasable once the insert has been modified and the insert has been reinserted into the sleeve. The package only comprises a second locking when the first locking mechanism is adapted to be releasable. The locking mechanism may prevent the insert from being reextraced by a first locking member adapted to be in connection with a second locking member. The releasing mechanism may release the connection between the first and second locking members. The unreleaseable locking mechanism may prevent the insert from being reextracted by a first locking member adapted to be in connection with a second locking member, which second locking member is revealed or formed after the insert has been modified. The first locking member is preferably located in the sleeve and the second locking member is preferably located in the insert.

Advantages with the different locking mechanisms are the same as discussed above for the corresponding features.

The insert of the package may also be adapted so that reextraction of the insert from the sleeve only is limited or denied in case the insert has received the part of the product before being reinserted into the sleeve. In this way it is assured that the insert has received the part of the product before access to the insert, and thus also to the part of the product, is limited or denied. This may be achieved by adapting the insert in such manner that receipt of the part of the product only can be possible once the insert has been modified such that a locking member is revealed or formed. Also, the received part of the product may form or reveal a locking member. The revealed or formed locking member may connect with a locking member located in the sleeve once the insert is reinserted into the sleeve and reextraction of the insert is thus limited or denied.

In this context it may be noted that the insert may be sold as a separate unit adapted to be put into a sleeve thereby forming a package of the kind disclosed above.

An insert may be adapted to be used in a package as described above, wherein the insert is adapted to be movably, and at least partly extractably, received in a sleeve, the insert is adapted to carry a product of which product at least one part remains after usage, wherein the product is accessible only after the insert is at least partly extracted from said sleeve, the insert is adapted to receive and carry said part of the product after usage of the product, the insert is adapted to be reinserted into the sleeve after receipt of said part of the product and the sleeve is adapted to enclose the reinserted insert such that access to said part of the product is limited or denied, the insert is adapted such that reextraction of the insert is limited or denied once the insert has been reinserted into said sleeve.

Advantages with the insert are discussed in relation to the corresponding features of the package.

BRIEF DESCRIPTION OF THE DRAWINGS

The invention will by way of example be described in more detail with reference to the appended schematic drawings, which shows a presently preferred embodiment of the invention.

DETAILED DESCRIPTION OF PREFERRED EMBODIMENTS

As shown in FIGS. 1-6 the package basically comprises a sleeve 10 and an insert 20. The sleeve 10 is formed of a blank with a plurality of panels defined by a plurality of fold lines. The sleeve 10 is folded into a basically parallelepepedic hollow body in which the insert 20 is slidable received. Such a basic configuration is e.g. disclosed in WO2006/068602 A1.

Figure 2:
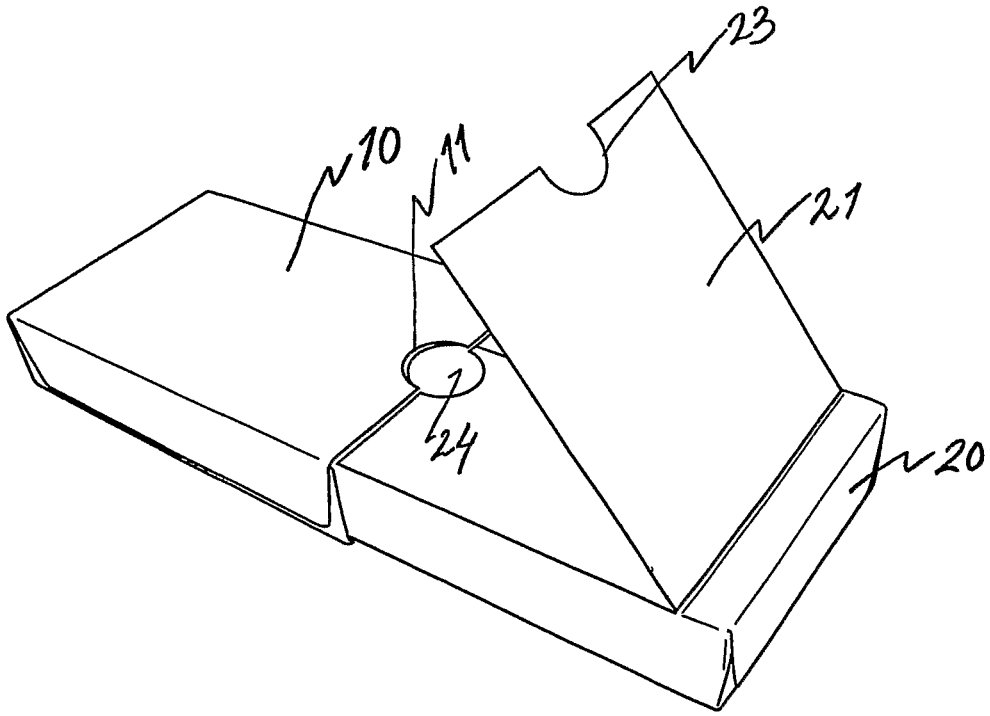
FIG. 2 shows that one part of the insert has been opened.
Figure 5:
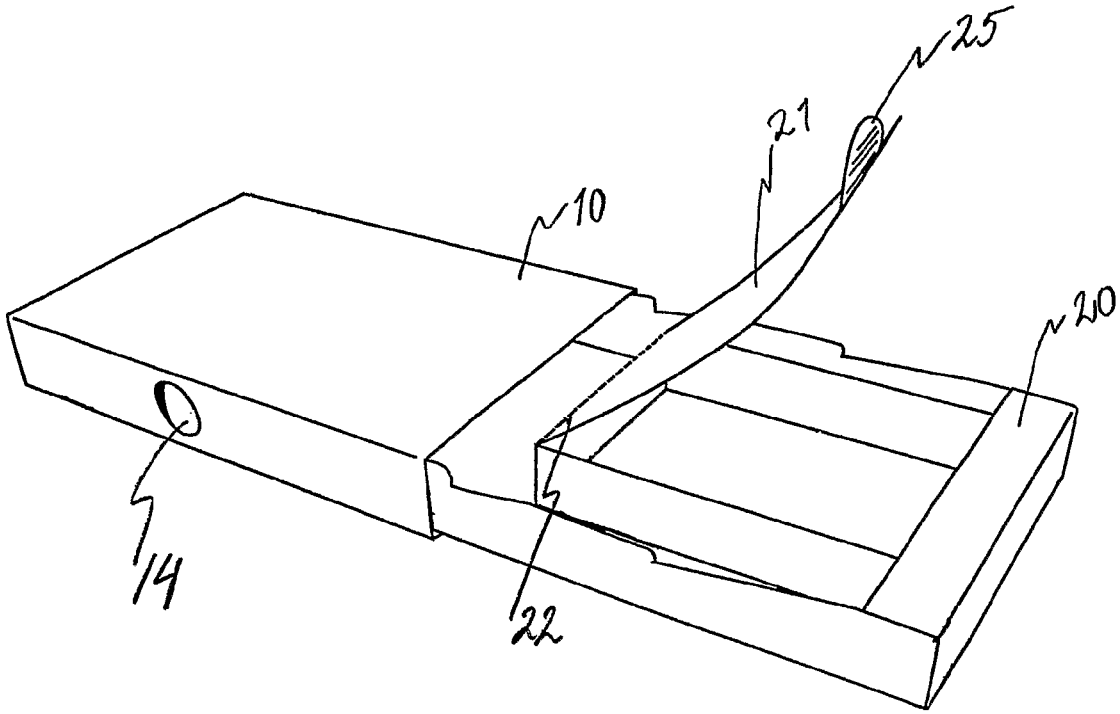
FIG. 5 shows that one part of the insert has been opened.

The insert 20 is adapted to carry a product and at least one part of the product remains after usage. The product is only available after at least one part of the insert 21 is separated. The part of the insert can be lifted and separated from the insert by tearing it along one or several perforation lines 22 as shown in FIGS. 2 and 5. The insert 20 may also be adapted to receive a product, which has not been kept in the insert 20 before the insert has been modified.

According to the embodiment shown in FIG. 2, the part of the insert 21 is adapted to be separated by the user gripping a cut-out 23 formed in the insert 20 and tearing this part of the insert 21 off.

According to the embodiment shown in FIG. 5, the part of the insert 21 is adapted to be separated by the user gripping a grip portion 25 and tearing this part of the insert 21 off. The grip portion 25 is a part of or in connection to the part of the insert 21 being separated from the insert 20.

The package formed of the sleeve 10 and the insert 20 (and optionally other elements) is provided with a locking mechanism that is activated once the product has been removed from the insert 20 and the insert 20 has been reinserted into the sleeve 10.

Figure 1:
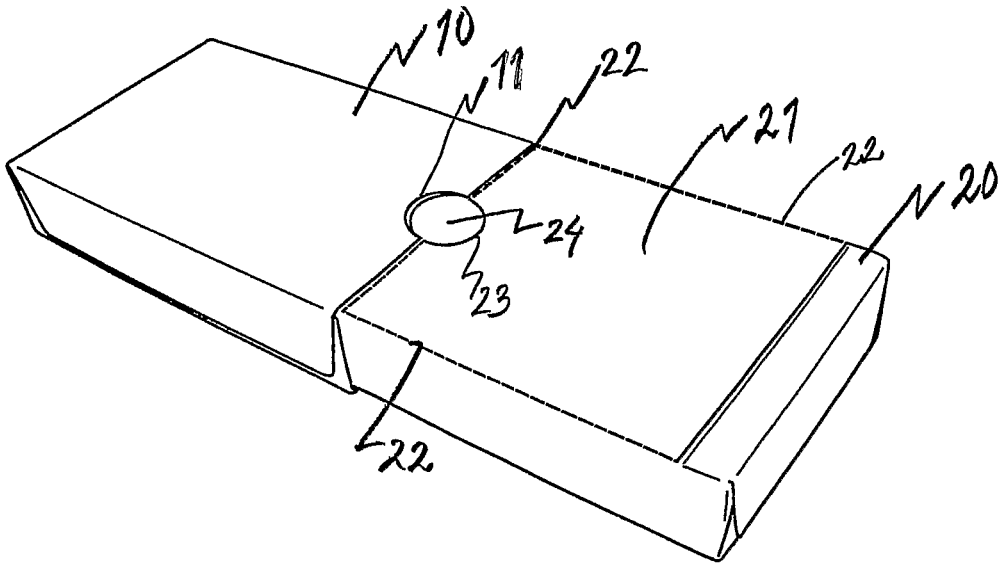
FIG. 1 shows a package where the insert has been extracted from the sleeve.
Figure 3:
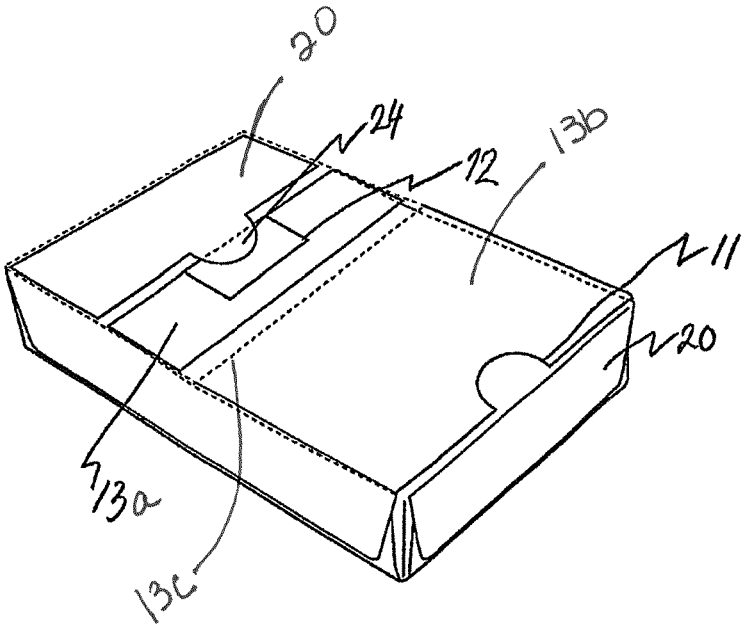
FIG. 3 is a partial cutaway that shows the interaction of the locking members forming the locking mechanism of a closed package.

The embodiments described in FIGS. 1-3 show a package wherein the sleeve 10 is provided with a cut-out 11. The insert 20 is slid into the sleeve 10 to such an extent that the insert 20 is enclosed by the sleeve 10 and not accessible to the user. The insert 20 is however accessible to the user by the cut-out 11 located in the sleeve. A user may grip the insert 20 at the cut-out 11 and pull the insert 20 out from the sleeve 10.

FIGS. 2-3 shows that by separating one part of the insert 21 by gripping the cut-out 23 a corresponding tongue 24 is formed on the insert 20. The tongue 24 forms a locking member 24 that is connected with a locking member 12 located in the inner part of the sleeve 10. One panel 13 of the sleeve 10 is preferably made of two panels, an inner panel 13*a* and an outer panel 13*b*, wherein the locking member 12 is located in the inner panel of the sleeve. In FIG. 3, a portion of the outer panel 13*b* is cut-away (as indicated by dashed lines 13*c*) to show the inner panel 13*a*. The locking member 12, preferably a locking flap, locking arc or a cut-out, connects with the locking member 24 of the insert as is seen in FIG. 3. The locking member 24 of the insert 20 and the locking member 12 of the sleeve 10 connect with each other and the insert 20 is thus prevented from being reextracted from the sleeve 10. It is also possible that the panel 13 of the sleeve 10 is a single panel and that the locking member 24 of the insert 20 will connect and extend through the cut-out 12 forming the locking member 12 of the sleeve. In this way, and the locking member 24 of the insert will be visible to the user once the package is locked. The locking mechanism of the package is unreleaseable, i.e. it is not possible to unlock the two locking members 12 and 24 once they have connected. Before the insert 20 is reinserted into the sleeve 10 the remaining part of the product must be reinserted into the insert 20.

The first locking member 12 is preferably located in the sleeve 10 and the second locking member 24 is preferably located in the insert 20. In this way, the connection of said first and second locking members (12 and 24) will prevent the insert 20 from being reextracted from the sleeve 10. For example, the insert 20 can be modified by separating one part of the insert 20 in such a manner that a locking member 24 of the insert 20 is revealed. The insert 20 may also be modified by folding one part of the insert 20 in such a manner that a locking member 24 is formed, for example by refold one part of the insert 20 so that a tongue or locking flap is formed on the insert 20. The revealed or formed locking member 24 may be adapted to connect with a locking member 12 of the sleeve 10, preferably a locking flap, locking arc or a cut-out, thus preventing the modified insert 20 from being reextracted from the sleeve 10.

Figure 4:
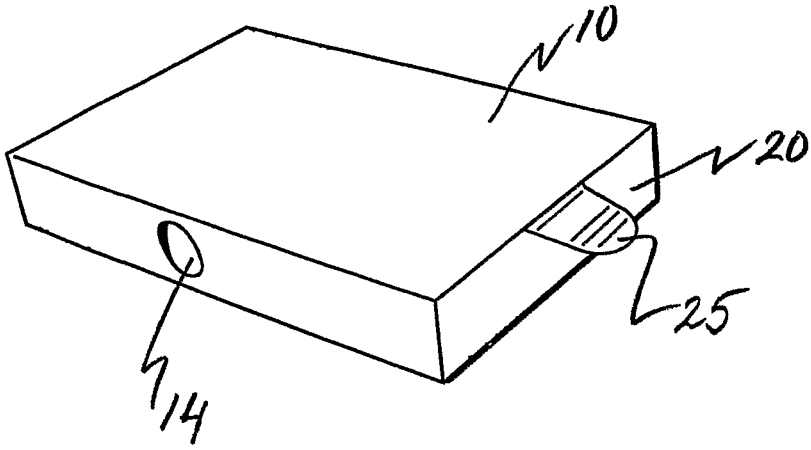
FIG. 4 shows a closed package.
Figure 6:
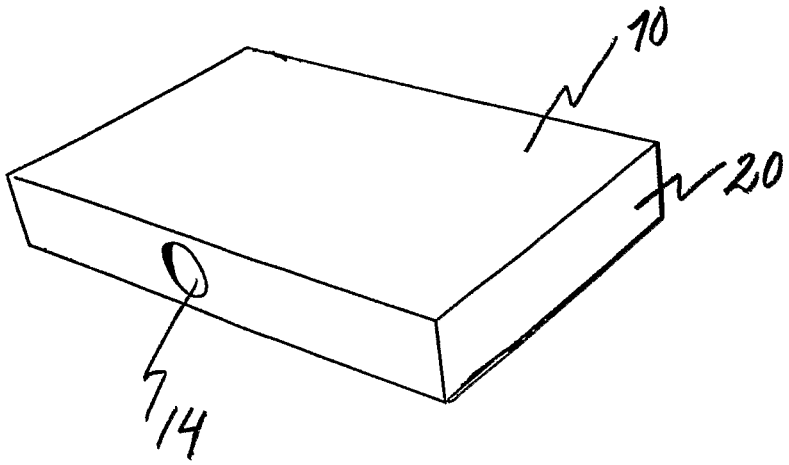
FIG. 6 shows a closed package.

The embodiments described in FIGS. 4-6 show a package wherein the insert 20 is provided with or connected to a grip portion 25. The insert is slid into the sleeve 10 to such an extent that the insert 20 is enclosed by the sleeve 10 and not accessible to the user. The grip portion 25 is however accessible to the user when the insert 20 is slid into the sleeve 10 to such extent. The insert 20 is at least party-partly slidably extracted from the sleeve 10 by pulling the grip portion 25. As shown in fig-FIG. 5, the product carried by the insert 20 is revealed by separating one part 21 of the insert 20. The part of the insert 21 is separated by lifting the grip portion 25 and thus tearing the part of the insert 21 together with the grip portion 25 apart from the insert 20. The insert 20 is reinserted into the sleeve 10 to such extent that the insert 20 is enclosed by the sleeve 10 and not accessible to the user, access to the insert 20 is thus limited or denied since the grip portion 25 has been separated from the insert, as is shown in FIG. 6.

The package may further be provided with a releasable locking mechanism which limits access to the product before usage. The locking mechanism comprises a locking member of the insert 20, a locking flap or locking arc inside the sleeve 10 and at least one push button 14 accessible to the user from the outside of the sleeve 10. If the user tries to pull the insert 20 out of the sleeve 10, without releasing the locking mechanism, movement of the insert 20 is prevented. The locking mechanism is released by pressing the push button 14 and at the same time extract the insert 20 from the sleeve 10 by pulling the grip portion 25.

The sleeve 10 is preferably made of paperbased or polymerbased laminate structure. The insert is preferably made of paperbased or polymerbased laminate structure.

It is contemplated that there are numerous modifications of the embodiments described herein, which are still within the scope of the invention ad defined by the appended claims.

The modification of the insert may reveal a marking, for example a panel which is of another color, which may be used to disclose to a user if the product has been used and the package should be disposed of. Furthermore, the removal of the grip portion may also be used to disclose if the product has been used and the package should be disposed of. By providing a single panel of the sleeve with a locking member, the locking member of the insert will be revealed to a user after the package is locked and it can thus be used to disclose to the user if the product has been used and the package should be disposed of. It is also possible provide the package with some kind of tamper proof marking in order for the user to see if the package has been opened.

The insert may e.g. be prevented from being completely pulled out of the sleeve by making use of a panel as a refolded retaining mechanism co-operation with an opening, panel or arc formed in the sleeve.

The invention claimed is:

1. A package for a product comprising:

a sleeve; and an insert for carrying the product, said insert being at least partially extractably received by said sleeve, said insert having a first panel, said first panel of said insert comprising a separable portion separably connected to a first locking member by scores or perforations;

said separable portion of said insert being separable when said insert is at least partially extracted from said sleeve, forming a modified insert;

said first locking member on said insert, said first locking member being revealed when said separable portion of said insert is separated to form said modified insert;

a second locking member on said sleeve, said first and second locking members engaging each other when said modified insert is reinserted into said sleeve; wherein upon re-insertion of said modified insert into said sleeve, said second locking member engages said first locking member to limit or deny re-extraction of said modified insert from said sleeve after re-insertion of said modified insert into said sleeve; and wherein said first locking member comprises a tongue or a locking flap, and wherein said second locking member comprises a locking flap, a locking arc, or a locking cutout.

2. The package of claim 1, wherein said portion of said insert is modifiable by tearing said portion.

3. The package of claim 2, wherein said separable portion is connected to said insert by the perforations.

4. A package for at least one product, the product being of the type that at least a part of the product remains after use, the package comprising:

a sleeve;

an insert being movably and at least partly extractably received in said sleeve and configured to carry the product, said insert including a modifiable panel that is scored or perforated to be separable from said insert, said modifiable panel comprising a separable portion separably connected to a first locking member by scores or perforations, wherein the product is accessible only after said insert is at least partly extracted from said sleeve and said modifiable panel is separated from said insert to form a modified insert, said first locking member being formed on said insert when said modifiable panel is separated from said insert, said modified insert being re-insertable into said sleeve; and wherein said sleeve includes a second locking member wherein upon re-insertion of said modified insert into said sleeve said second locking member engages said first locking member to limit or deny re-extraction of said modified insert from said sleeve after re-insertion of said modified insert into said sleeve; and wherein said first locking member comprises a tongue or a locking flap, and wherein said second locking member comprises a locking flap, a locking arc, or a locking cutout.

5. The package of claim 4, wherein said insert includes a grip portion accessible to a user while said insert is received in said sleeve, and wherein separating said modifiable part to form said modified insert removes said grip portion.

6. The package of claim 4, wherein the modified insert is configured to receive the part of the product remaining after use before said modified insert is re-inserted into said sleeve.

7. A package for at least one product, the product being of the type that at least a part of the product remains after use, the package comprising:

a sleeve; and an insert being movably and at least partly extractably received in said sleeve and configured to carry the product, said insert including a modifiable panel including a grip portion, said modifiable panel comprising a separable portion separably connected to a first locking member by scores or perforations and said grip portion accessible to said user while said insert is received in said sleeve, wherein the product is accessible only after said insert is at least partly extracted from said sleeve and said modifiable panel is separated from said insert to form a modified insert, said modified insert being re-insertable into said sleeve, wherein separating said modifiable panel to form said modified insert removes said grip portion; and wherein said sleeve includes a second locking member, wherein upon re-insertion of said modified insert into said sleeve, said second locking member engages said first locking member to limit or deny re-extraction of said modified insert from said sleeve after re-insertion of said modified insert into said sleeve; and wherein said first locking member comprises a tongue or a locking flap, and wherein said second locking member comprises a locking flap, a locking arc, or a locking cutout.

* * * * *